US007170538B2

(12) United States Patent
Klein

(10) Patent No.: US 7,170,538 B2
(45) Date of Patent: Jan. 30, 2007

(54) THERMAL AND INKJET PRINTER

(75) Inventor: Rudolph J. Klein, Centerville, OH (US)

(73) Assignee: Paxar Americas, Inc., Miamisburg, OH (US)

( * ) Notice: Subject to any disclaimer, the term of this patent is extended or adjusted under 35 U.S.C. 154(b) by 155 days.

(21) Appl. No.: 10/950,863

(22) Filed: Sep. 27, 2004

(65) Prior Publication Data

US 2006/0072001 A1 Apr. 6, 2006

(51) Int. Cl.
*B41J 3/44* (2006.01)
*B41J 3/54* (2006.01)

(52) U.S. Cl. ..... 347/171; 347/2; 347/4

(58) Field of Classification Search ..... 347/2, 347/3, 4, 171, 172, 174, 176
See application file for complete search history.

(56) References Cited

U.S. PATENT DOCUMENTS 4,846,503 A 7/1989 Strauss
5,462,909 A 10/1995 Lakes et al.
5,561,500 A 10/1996 Ohzeki et al.
5,570,451 A 10/1996 Sakaizawa et al.
5,592,262 A 1/1997 Tanaka et al.
5,748,204 A 5/1998 Harrison
6,151,037 A * 11/2000 Kaufman et al. ..... 347/2

FOREIGN PATENT DOCUMENTS

EP 0 361 780 B1 7/1993
EP 0 782 929 B1 7/2001
EP 0 928 698 B1 11/2003
JP 10-337912 * 12/1998

* cited by examiner

*Primary Examiner*—Huan Tran
(74) *Attorney, Agent, or Firm*—Joseph J. Grass

(57) ABSTRACT

There is disclosed a method using thermal and inkjet printing and a combination thermal and inkjet printer includes a thermal print head, an inkjet print head and at least one motor for driving a web of record members, such as labels past the thermal print head and the inkjet print head. A controller controls the thermal print head and the inkjet print head while the inkjet print head remains stationary to print on a record member as the record member moves continuously past each of the print heads at the same speed to provide a simple, fast and inexpensive and less complex combination thermal and inkjet printer than prior combination printers. The thermal print head is used to print data and the ink jet print head is used to print marks of any of various contrasting colors.

17 Claims, 3 Drawing Sheets

THERMAL AND INKJET PRINTER

BACKGROUND OF THE INVENTION

1. Field of the Invention

The present invention relates to the field of printing on record members such as tickets, tags, labels and other printable media.

2. Brief Description of the Prior Art

The following prior art is made of record: U.S. Pat. Nos. 4,846,503; U.S. Patent 5,462,909; U.S. Patent 5,561,500; U.S. Patent 5,570,451; U.S. Patent 5,592,262; U.S. Patent 5,748,204; EP 0 361 780B1; EP 0 782 929B1; and EP 0 928 698B1.

It is known to print data on record members in a web in a printer, wherein a marking pen of a selected color mounted in the printer and held against the web marks a color stripe along the entire length of the web as the web moves through the printer.

Prior to the present invention, the retail industry supplied record members made from rolls of different color stock or record members preprinted with different colored stripes or indicia thereon. However, this required a large inventory of supply rolls of the various colors and also the supply roll in the printer had to be changed for printing the record members with different color stock or colored stripes. This was an extremely cumbersome and expensive operation for the retailer.

SUMMARY OF THE INVENTION

This invention relates to an improved printer that uses both a thermal print head and an ink jet print head. The thermal print head is controlled to print data on record members of a web, and the ink jet print head is used to print marks such as longitudinal stripes or other shapes or data on the record members in a variety of colors. In the illustrated embodiment, the color of the mark is matched to and is related to the size printed on the record member, there being a different color code for each size. Typically, the thermal printing is accomplished by having thermally coated record members or by having plain paper record members using a thermal ink ribbon. The color of the printing using either thermal direct or thermal transfer printing is usually black, although color thermal papers and colored ink ribbons are commercially available that can cause data to be printed in selected colors. However, because of the cost of such color-printing with thermal papers and ink ribbons is higher than printing data in black, it is preferred to use standard thermal papers or ink ribbons that print in the color black.

An inkjet printer could print both the variable data and color marks, but at higher cost and slower speed than the combination printer of the invention.

According to the present invention, it is desired to print data using a thermal print head to produce black printing, and to use an ink jet print head to print visually identifiable marks in any selected color. For example, when printing marks to indicate one of several sizes, one of several different colors can be printed selectively. If, on the other hand, date coding is desired, there can be a different color for each day of the week. The marks can be in a stripe running from end-to-end of a record member, or they can be intermittent such as a bar, or a selected shape, dots, data, or the like. The mark can be over or adjacent part or all of the data. When the mark is over or adjacent part of the thermally printed data, that part of the data is thereby highlighted without being obscured.

It is preferred that the printing of the thermal data and the color-contrasting marks can occur while the web of record members is moving continuously through the printer without forming a loop or intermittent motion in the web during movement of the web. Accordingly, a single motor can be used to advance the web by means of one or more web advancing rolls driven by the motor.

A feature of the invention is that the control system enables the full content of the record members to be printed including the color and location of the colored marks, without the need for operator attention to generate correct combinations of printed text and marks of selected colors and locations.

It is a feature of the invention to provide a narrow ink jet print head which is substantially narrower than the thermal print head in the direction lateral to the movement of the web. It is preferred that the inkjet print head be stationary during use, and that only narrow marks be printed. This enables a low cost print head to be used.

These and other advantages and novel features of the present invention, as well as details of an illustrated embodiment thereof, will be more fully understood from the following description and drawings.

BRIEF DESCRIPTION OF THE DIAGRAMMATIC DRAWINGS

FIG. 1 a perspective view of a printer in accordance with the invention;

DETAILED DESCRIPTION OF THE PREFERRED EMBODIMENTS

Figure 1:
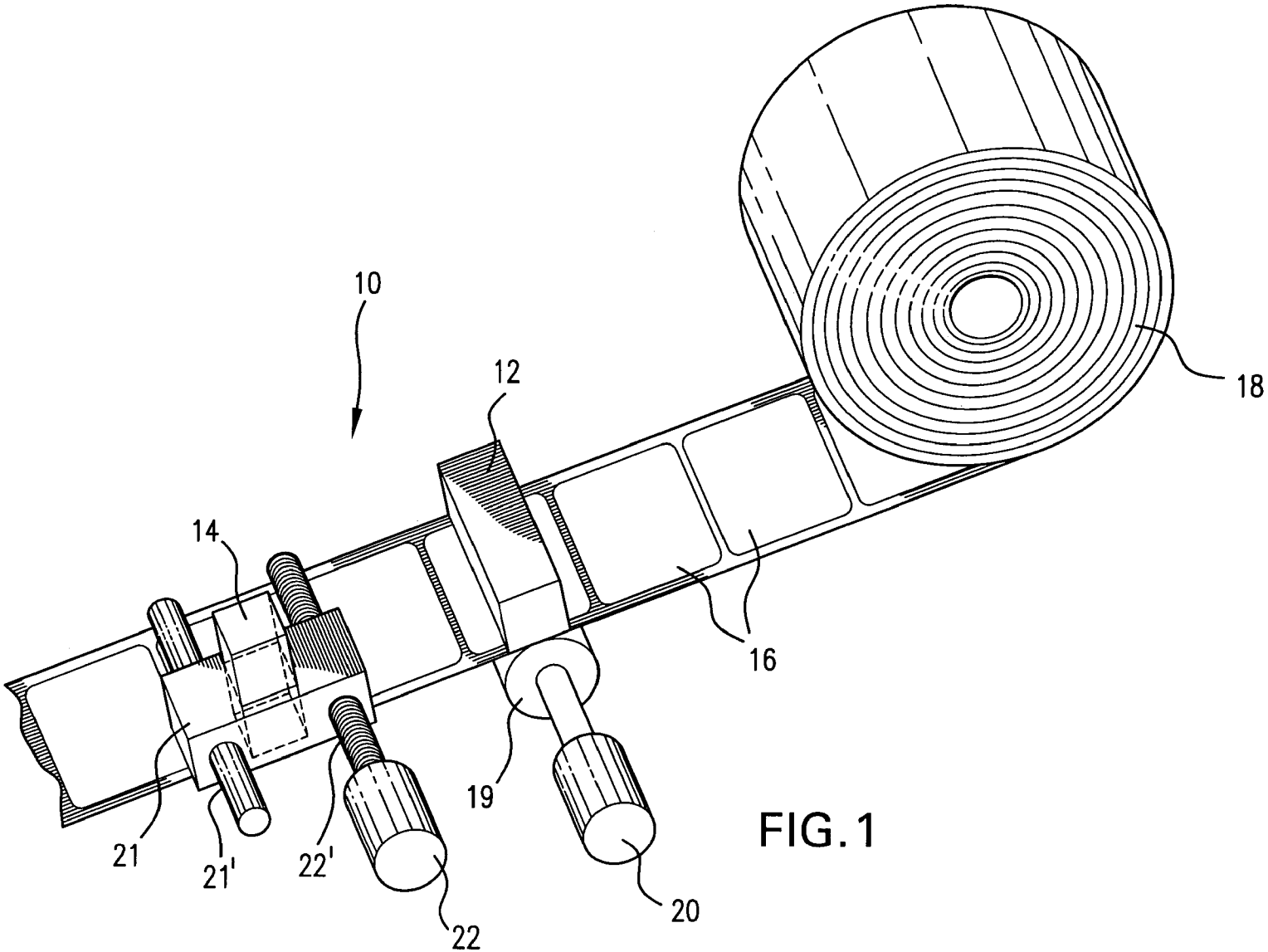
Figure 2:
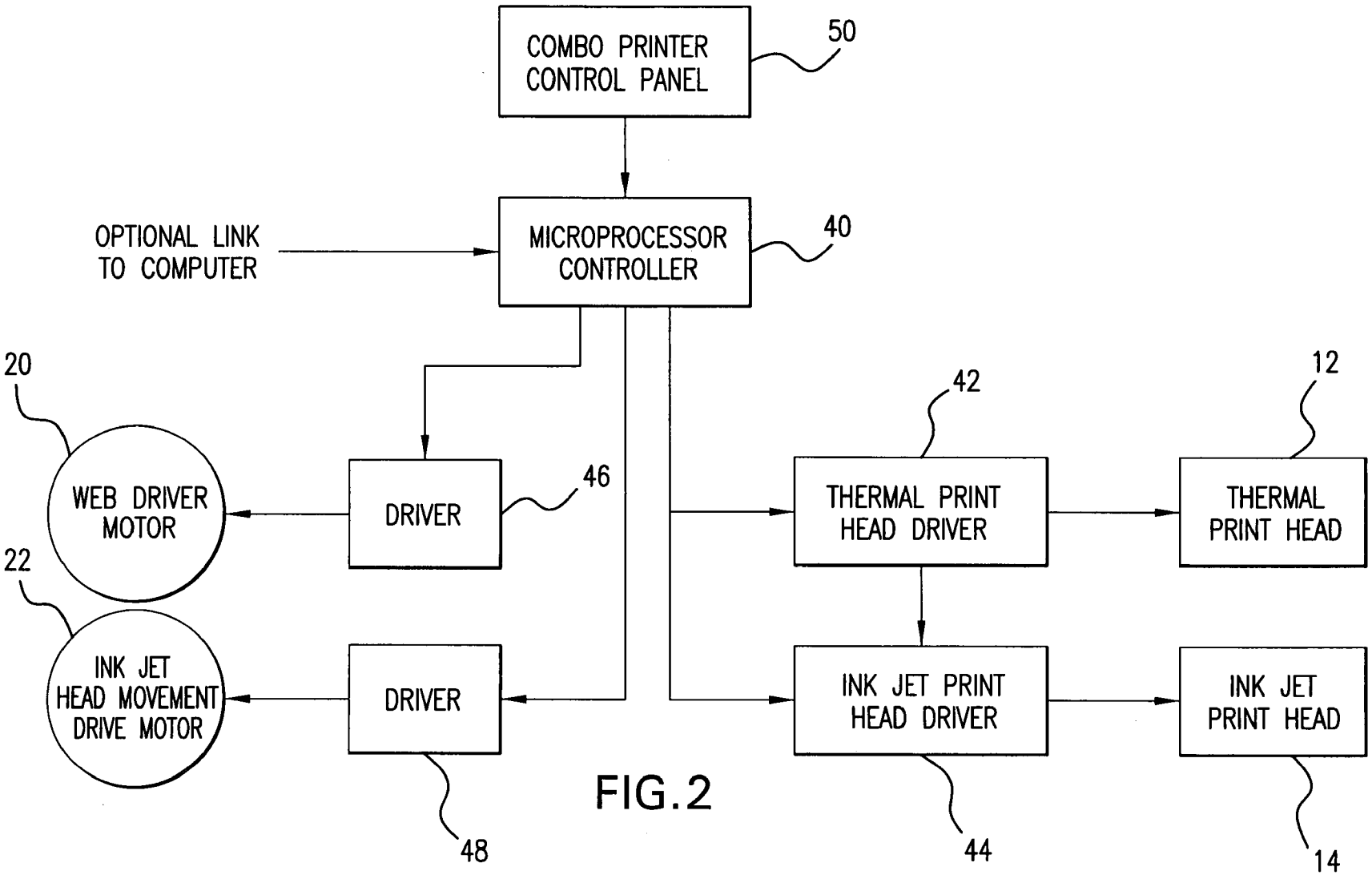
FIG. 2 is a block diagram of the printer.

A combination thermal and inkjet printer 10 as shown in FIGS. 1 and 2 includes a thermal print head 12 and an inkjet print head 14 for printing on a web of record members 16 such as tickets, labels, tags or the like dispensed from a supply roll web 18 that is supported in or on the combination printer in any manner known in the art. The print head 12 and the print head 14 are preferably stationary during use, however, the print head 14 is manually or automatically settable to print at different positions across the width of the web 18. The inkjet print head is narrow and, indeed, substantially narrower than the width of the web of record members and substantially narrower than the width of the thermal print head 12. Accordingly, the print head 14 need only be wide enough to print the desired width stripe or mark 15. As shown, the print head 14 is wider than the mark 15, but it can be narrower yet. Accordingly, the narrow inkjet print head is low cost because it has relatively few nozzles. The combination printer 10 includes a single motor 20 that drives a platen roller 19 cooperating with the thermal print head 12 for moving the web of labels past both the thermal print head 12 and the inkjet print head 14 at the same speed. The cross-web positioning of the inkjet print head takes place during initialization of the printer 10 prior to printing a batch of record members which use the same format. When a different set-up is required to print the marks by use of the inkjet print head at a different lateral position across the web, then the inkjet print head 14 is repositioned.

The thermal print head 12 preferably extends across the entire width of the label web to enable the thermal print head to print at any location across the width of the label 16, where the width of the label web extends in a direction perpendicular to the direction of web movement. The inkjet print head has one or more sets of nozzles 24, 26, 28 and 30 for dispensing ink of a given color where the nozzles for the same color ink may extend across the width of the web for inkjet printing at any position across the width of the web. However, in a preferred embodiment, the nozzles for dispensing ink of one color do not extend across the entire width but only partially thereacross. In this embodiment, the nozzles of the replaceable inkjet print head 14 are supported on a movable frame 21. A second motor 22 is used to rotate a screw 22' to move the frame 21 of the inkjet print head 14 into a desired position while guided on a rod 21' laterally across the width of the web, i.e. in a direction perpendicular to the web movement to allow the inkjet print head 14 to print at any position across the width of the web.

Figure 3:
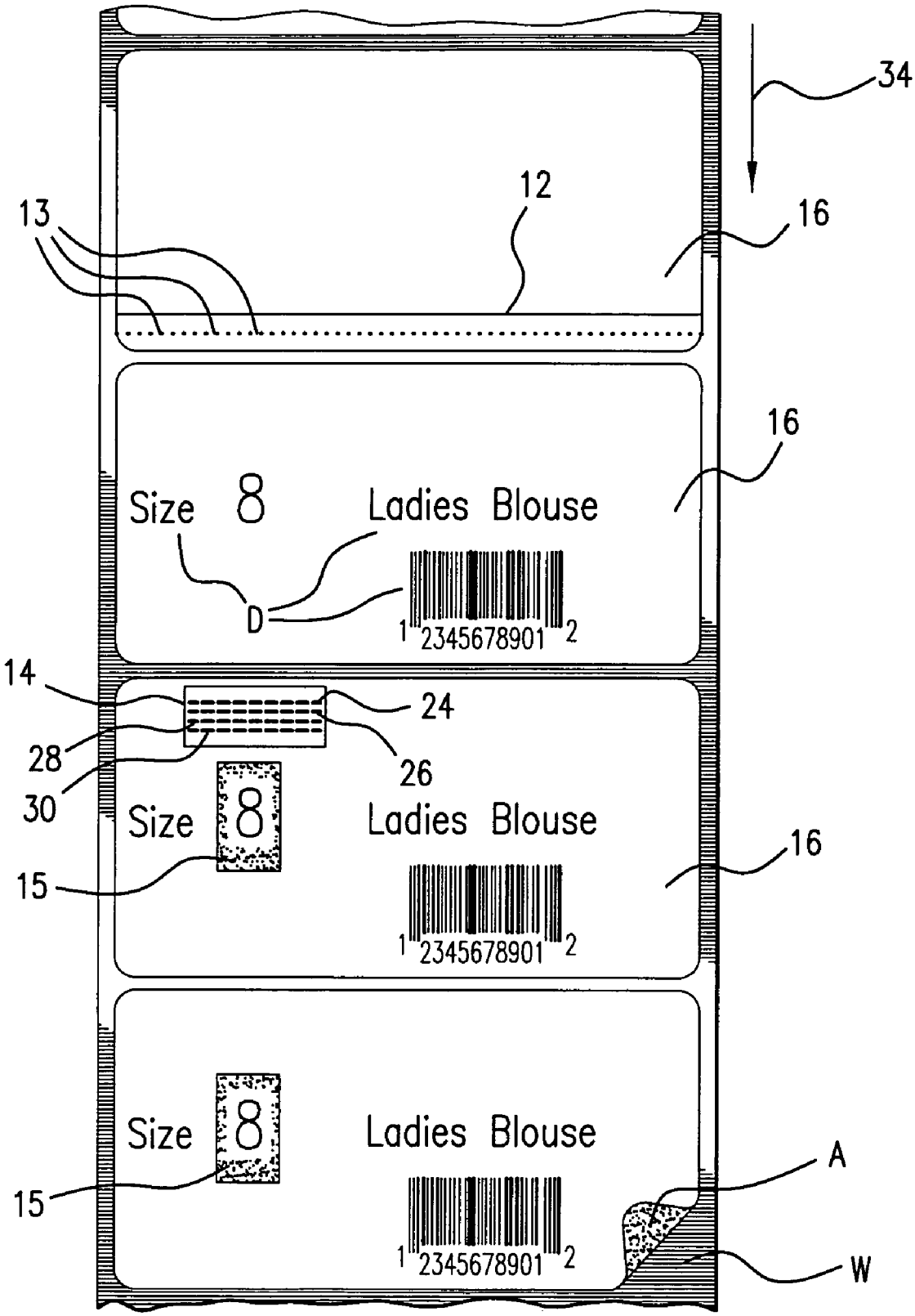
FIG. 3 is a top plan view of certain components of the printer showing resulting printing on a web of record members.

As shown in FIG. 3, the inkjet print head 14 preferably includes nozzles for dispensing more then one color of ink. In a preferred embodiment, the inkjet print head 14 includes one or more nozzles 24 for dispensing cyan ink, one or more nozzles 26 for dispensing magenta ink, one or more nozzles 28 for dispensing yellow ink and optionally one or more nozzles 30 for dispensing black ink. As discussed above, the nozzles dispensing ink of the same color are positioned adjacent to each other in a direction that extends across or partially across the width of the web 32. The nozzles 24, 26, 28 and 30 associated with the different colors are aligned along the length of the label web 32 in the direction 34 of the web movement. By actuating nozzles that are aligned in the direction of web movement 34 but associated with different colors such as cyan and yellow, for example, the inkjet printer can combine the three colors magenta, cyan and yellow to print in a wider variety of colors. As shown in FIG. 3, the web 16 travels in the direction of arrow 34 past the thermal print head 12 having closely spaced dot heating elements 13 and past the inkjet print head 14 having the rows of the nozzles 24, 26, 28 and 30. The print head 12 illustrated as having printed the same data D, namely "Size 8", "Ladies Blouse" and a bar code on each record member 16. The inkjet print head 14 is shown as printing a mark 15 in a selected color over part of the data to highlight without obscuring that part of the data. The size "8" could also be printed in the same color as the mark 15, if desired. It saves ink to print discontinuous marks 15 as shown, however, continuous marks can be printed, if desired. In the illustrated embodiment, the record members 16 are labels adhered by pressure sensitive adhesive A to a carrier web W.

In a preferred embodiment of the present invention, the inkjet print head 14 is controlled to print lines of one or more contrasting colors on a given record member, i.e. label, tag or the like. The line or lines that are printed by the inkjet printer 14 on a given label 16 may be continuous or intermittent, i.e. formed of dots and/or dashes. The thickness of a line is determined by the number of adjacent nozzles that are actuated at the same time. For example, a very thin line of cyan can be printed on a label by actuating a single cyan nozzle 24. Alternatively, a thicker cyan line can be printed on a label by actuating multiple, adjacent cyan nozzles 24. Because the inkjet print head of the present invention is controlled to print either continuous or intermittent lines on a label, the label web W can move past the inkjet print head 14 during an inkjet printing operation at the same speed that the web is moving past the thermal print head during a simultaneous thermal printing operation. Printing different colored lines on labels by the inkjet print head 14 along with text and barcode information printed by the thermal print head 12 allows labels and tags to be printed with a strong visual color indication quickly and less expensively than has heretofore been possible. Different color lines or stripes can be associated with different sizes so that both the retailer and the customer can easily pick out a given size from a rack supporting multiple sizes. In accordance with the present invention however, the inkjet print head 14 can print lines of a large number of different colors, automatically, before or after the printing of text and/or barcode information by the thermal print head 12. Because the motor 20, drives the web of record members past both print heads 12 and 14 at the same speed, a simple, inexpensive printer is provided.

As shown in FIG. 1, the thermal print head 12 is controlled to print on one label which thereafter advances to the inkjet print head 14 which prints a colored line or the like on the label. In an alternative embodiment, the position of the inkjet print head 14 and the thermal print head 12 are exchanged so that inkjet printing occurs prior to the thermal printing on the same label. Further, although as shown in FIG. 1, the thermal print head 12 and the inkjet print head 14 are positioned so that the thermal print head 12 is printing on one label while simultaneously the inkjet print head is printing on an adjacent label, the print heads 12 and 14 can be spaced further apart so that one or more labels may be disposed between the label being simultaneously printed on by the thermal print head 12 and the label being printed on by the inkjet print head 14. Controls in the microprocessor in FIG. 2 can be such as to provide thermal and inkjet printing on the same long label or to allow one or more short labels to be positioned between the thermal and ink jet print heads while still placing the colored mark on each label in the desired location.

FIG. 2 shows a microprocessor based controller 40 for controlling the thermal print head 12, the inkjet print head 14, the web motor 20 and the inkjet print head motor 22 through respective drivers 42–48. The microprocessor controller 40 operates in accordance with software stored in a memory such as flash memory to print data that is stored in, for example, a random access memory of the controller. Data, format, and font information can be input to the microprocessor controller 40 by a control panel 50 having a full keyboard if desired. Alternatively, the control panel 50 may have only a limited number of keys for controlling the operation of the printer. In this latter embodiment, data is input to the printer 10 for printing under the control of the microprocessor controller 40 from another computer. The printer 10 may be coupled to the other computer via a cable or wireless communication via a radio or the like included, but not shown in the printer 10. The microprocessor controller controls the thermal print head 12 to print text and/or barcode information on each label while simultaneously controlling the inkjet print head 14 to print colored indicia, such as a mark or stripe or member at the appropriate location on another label. The microprocessor controller 40 controls the motor 20 to move the web of labels past the print heads 12 and 14 for respective thermal printing and inkjet printing. It should be noted, that although the movement of the web past the print heads 12 and 14 is continuous during simultaneous thermal and inkjet printing on two labels, the movement of the label web may be stopped and reversed in between the printing of two simultaneous labels by the respective print heads 12 and 14 so as to allow the next successive pair of labels to be printed on, to be registered with respect to the thermal print head 12 and the inkjet print head 14. In a preferred embodiment, registration is controlled by a mark sensor associated with, for example the thermal print head 12 as is well known in the art. The thermal print head 12 and inkjet print head 14 are preferably spaced from each other along the direction of web movement so that when one label is registered with the thermal print head 12 for thermal printing thereon, another label is registered with the inkjet print head 14 for inkjet printing thereon. The microprocessor controller 40 also controls the motor 22 for positioning the inkjet print head 14 laterally across the width of the label web upon rotation of the motor-driven screw 22' as discussed above so that indicia such as a colored line can be printed at any location across the width of the label, the printed line extending in the direction of label movement. The microprocessor 40 preferably controls the movement of the inkjet print head via the motor 22 during initialization or batch set up while the web is stationary and not during an inkjet printing operation.

The combination thermal and inkjet printer 10 of the present invention allows text and barcode information as well as other graphic characters to be printed by the thermal print head 12 and on the same label a colored stripe or mark can be printed by the inkjet print head 14. The combination printer 10 of the present invention accomplishes the thermal and inkjet printing very fast and inexpensively by utilizing the best features of both thermal and ink jet printing technologies used where they are appropriate to accomplish the purposes of the invention.

Many modifications and variations of the present invention are possible in light of the above teachings. Thus, it is to be understood that, within the scope of the appended claims, the invention may be practiced otherwise than as described hereinabove.

I claim:

1. A method of controlling a combination thermal and inkjet printer including an inkjet print head having a plurality of nozzles to print a plurality of different colors and a thermal print head, comprising:

printing data on a first record member of a web of record members with the thermal print head;

printing a colored mark on a second record member with the inkjet print head, controlling the thermal print head to print data and the inkjet nozzles to print the selected color, and continuously moving the web of record members past the thermal print head and the inkjet print head at the same speed during the thermal printing and the inkjet printing.

2. A method of controlling a combination thermal and inkjet printer as recited in claim 1, wherein the mark is a line of a selected color.

3. Method as defined in claim 1, wherein the inkjet printing step includes printing a code having code significance related to the printed data.

4. Method as defined in claim 1, wherein the data printed by the thermal print head relates to a selected size and the color printed by the inkjet print head prints is in a color related to the selected size.

5. Method as defined in claim 1, wherein the mark is discontinuous.

6. Method as defined in claim 1, including selectively positioning the inkjet print head at a selected lateral position across the web prior to inkjet printing.

7. A combination thermal and inkjet printer, comprising:

a thermal print head for printing data on a web of record members, an inkjet print head having nozzles to print marks on the web in a variety of selectable colors, wherein the thermal and inkjet print heads are stationary during printing on a continuously movable web, a motor for advancing the web continuously during printing, and a controller for controlling the thermal print head to print on one record member while the inkjet print head can print on another record member along the web.

8. A combination thermal and inkjet printer as defined in claim 7, wherein the controller controls the thermal print head to print data and the inkjet print head to print marks having code significance related to the printed data.

9. A combination thermal and inkjet printer as defined in claim 7, including a motor for moving the inkjet print head, wherein the controller controls the inkjet print head moving motor to position the inkjet print head at a selected lateral printing position across the web prior to printing.

10. A combination thermal and inkjet printer as defined in claim 7, wherein the thermal print head is wider in the lateral direction than the inkjet print head.

11. Method of printing data on and color-coding record members in a web, comprising:

providing a printer having a thermal print head capable of printing selected data on record members in a web and an inkjet print head having a plurality of nozzles capable of printing a plurality of different colors on the record members, printing data using the thermal print head and color-coding with the inkjet print head to print a code in a selected one of a plurality of different colors using one or more selected nozzles of the inkjet print head while continuously advancing the web, and wherein the selected printed code has a code significance related to the printed data.

12. Method as defined in claim 11, wherein the printing step includes superimposing thermally printed data and the printed code without obscuring the printed data.

13. Method as defined in claim 11, wherein the providing step includes providing a single inkjet print head.

14. Method as defined in claim 11, wherein the printing step includes printing intermittent marks in the selected color on each record member along the web.

15. Method as defined in claim 11, wherein the printing step includes printing a continuous stripe in the selected color on the record members lengthwise of the web.

16. Method as defined in claim 11, wherein the printing step includes printing intermittent marks in the selected color superimposed with printed data on each record member without obscuring the printed data.

17. Method as defined in claim 11, including selectively positioning the inkjet print head in a selected lateral printing position across the web prior to inkjet printing.

* * * * *